US008601717B2

(12) United States Patent
Beers et al.

(10) Patent No.: US 8,601,717 B2
(45) Date of Patent: Dec. 10, 2013

(54) APPARATUS AND METHOD FOR REFRIGERATION CYCLE CAPACITY ENHANCEMENT

(75) Inventors: David G. Beers, Louisville, KY (US); Nicholas Okruch, Jr., Mt. Washington, KY (US); Brent Alden Junge, Evansville, IN (US); Amelia Lear Hensley, Louisville, KY (US)

(73) Assignee: General Electric Company, Schenectady, NY (US)

( * ) Notice: Subject to any disclaimer, the term of this patent is extended or adjusted under 35 U.S.C. 154(b) by 202 days.

(21) Appl. No.: 13/052,548

(22) Filed: Mar. 21, 2011

(65) Prior Publication Data

US 2012/0017466 A1 Jan. 26, 2012

Related U.S. Application Data

(63) Continuation-in-part of application No. 12/843,148, filed on Jul. 26, 2010, now Pat. No. 8,353,114.

(51) Int. Cl.
*F26B 3/02* (2006.01)

(52) U.S. Cl.
USPC ..... 34/419; 34/493; 34/550; 34/610; 62/238.6; 137/597; 68/139; 165/287

(58) Field of Classification Search
USPC ..... 34/413, 419, 493, 524, 527, 431, 543, 34/550, 610; 62/119, 228.1, 238.6, 235.1; 137/597; 68/3 R, 139; 165/287
See application file for complete search history.

(56) References Cited

U.S. PATENT DOCUMENTS

| | | | | | |
|---|---|---|---|---|---|
| 2,495,535 | A | * | 1/1950 | Morrison | 34/76 |
| 2,676,418 | A | * | 4/1954 | Shewmon | 34/77 |
| 3,250,097 | A | * | 5/1966 | Czech | 68/12.09 |
| 3,290,793 | A | * | 12/1966 | Jacobs et al. | 34/76 |
| 3,426,555 | A | * | 2/1969 | McCutcheon, Jr. | 68/12.08 |
| 3,861,056 | A | | 1/1975 | Behrens | |
| 4,433,557 | A | | 2/1984 | McAlister | |
| 4,441,546 | A | * | 4/1984 | VanderVaart | 165/231 |
| 4,481,786 | A | | 11/1984 | Bashark | |
| 4,555,019 | A | | 11/1985 | Spendel | |
| 4,603,489 | A | * | 8/1986 | Goldberg | 34/77 |

(Continued)

FOREIGN PATENT DOCUMENTS

| | | | | |
|---|---|---|---|---|
| DE | 3406678 A1 | * | 9/1985 | F25B 29/00 |
| DE | 3543722 A1 | | 10/1987 | |

(Continued)

*Primary Examiner* — Steve M Gravini
(74) *Attorney, Agent, or Firm* — Global Patent Operation; Douglas D. Zhang

(57) ABSTRACT

An apparatus includes a mechanical refrigeration cycle arrangement having a working fluid and an evaporator, a condenser of adjustable surface area, a compressor, and an expansion device, cooperatively interconnected and containing the working fluid. The apparatus also includes a drum to receive clothes to be dried, a duct and fan arrangement configured to pass air over the condenser and through the drum, a sensor located to sense at least one parameter, and a controller coupled to the sensor, condenser and/or the compressor. The controller is operative to adjust the condenser to increase surface area during a steady state drying rate period of the cycle, and adjust the condenser to decrease surface area during a start transient period of the cycle, wherein adjusting the condenser to decrease surface area during a start transient period of the cycle accelerates the start transient period of the cycle.

19 Claims, 15 Drawing Sheets

(56) References Cited

U.S. PATENT DOCUMENTS

| | | | | |
|---|---|---|---|---|
| 4,621,438 | A | 11/1986 | Lanciaux | |
| 4,640,022 | A | 2/1987 | Suzuki et al. | |
| 4,800,655 | A * | 1/1989 | Mori et al. | 34/77 |
| 5,301,516 | A * | 4/1994 | Poindexter | 62/126 |
| 5,806,204 | A * | 9/1998 | Hoffman et al. | 34/92 |
| 6,557,266 | B2 * | 5/2003 | Griffin | 34/168 |
| 6,784,997 | B2 | 8/2004 | Lorenz et al. | |
| 7,010,363 | B2 | 3/2006 | Donnelly et al. | |
| 7,020,985 | B2 | 4/2006 | Casey et al. | |
| 7,055,262 | B2 | 6/2006 | Goldberg et al. | |
| 7,194,823 | B2 | 3/2007 | Nakamoto et al. | |
| 7,478,547 | B2 | 1/2009 | Okazaki et al. | |
| 7,653,443 | B2 | 1/2010 | Flohr | |
| 7,665,227 | B2 | 2/2010 | Wright et al. | |
| 7,735,345 | B2 | 6/2010 | Wright et al. | |
| 7,766,988 | B2 | 8/2010 | Roberts | |
| 7,812,557 | B2 | 10/2010 | Maekawa | |
| 7,866,061 | B2 | 1/2011 | Tatsumi et al. | |
| 7,908,766 | B2 | 3/2011 | Ahn et al. | |
| 7,921,578 | B2 | 4/2011 | McAllister et al. | |
| 8,132,339 | B2 | 3/2012 | Moon et al. | |
| 8,240,064 | B2 | 8/2012 | Steffens | |
| 8,245,545 | B2 | 8/2012 | Maekawa | |
| 8,266,824 | B2 | 9/2012 | Steiner | |
| 8,353,114 | B2 | 1/2013 | Beers et al. | |
| 8,387,273 | B2 * | 3/2013 | Driussi | 34/524 |
| 2006/0179676 | A1 * | 8/2006 | Goldberg et al. | 34/77 |
| 2006/0207299 | A1 | 9/2006 | Okazaki et al. | |
| 2006/0218812 | A1 * | 10/2006 | Brown | 34/86 |
| 2007/0017113 | A1 * | 1/2007 | Scharpf et al. | 34/86 |
| 2007/0107255 | A1 | 5/2007 | Tamura et al. | |
| 2008/0235977 | A1 | 10/2008 | Kuwabara | |
| 2009/0100702 | A1 * | 4/2009 | Fair | 34/487 |
| 2009/0139107 | A1 | 6/2009 | Grunert et al. | |
| 2009/0172969 | A1 | 7/2009 | Kim | |
| 2009/0255142 | A1 * | 10/2009 | Brown | 34/79 |
| 2010/0018228 | A1 * | 1/2010 | Flammang et al. | 62/115 |
| 2010/0070103 | A1 | 3/2010 | Fleck et al. | |
| 2010/0219183 | A1 | 9/2010 | Azancot et al. | |
| 2010/0219693 | A1 | 9/2010 | Azancot et al. | |
| 2010/0307018 | A1 * | 12/2010 | Driussi | 34/79 |
| 2011/0063126 | A1 | 3/2011 | Kennedy et al. | |
| 2011/0203300 | A1 * | 8/2011 | Rafalovich | 62/90 |
| 2011/0314805 | A1 * | 12/2011 | Seale et al. | 60/522 |
| 2012/0017465 | A1 | 1/2012 | Beers et al. | |
| 2012/0073062 | A1 | 3/2012 | Farid et al. | |
| 2012/0102781 | A1 * | 5/2012 | Beers et al. | 34/499 |
| 2012/0197562 | A1 | 8/2012 | Scelzi et al. | |
| 2012/0203380 | A1 | 8/2012 | Scelzi et al. | |
| 2012/0204587 | A1 * | 8/2012 | Zamir | 62/228.1 |
| 2012/0272689 | A1 * | 11/2012 | Elger et al. | 68/20 |
| 2012/0292008 | A1 * | 11/2012 | Goldberg | 165/287 |
| 2013/0008049 | A1 * | 1/2013 | Patil | 34/469 |

FOREIGN PATENT DOCUMENTS

| | | | | |
|---|---|---|---|---|
| DE | 4434205 | A1 | 3/1996 | |
| EP | 94356 | A1 | 11/1983 | |
| EP | 467188 | A1 | 1/1992 | |
| EP | 1209277 | A2 | 5/2002 | |
| EP | 1959047 | A1 * | 8/2008 | |
| EP | 2077350 | A1 * | 7/2009 | D06F 58/20 |
| JP | 06063298 | A * | 3/1994 | D06F 58/28 |
| JP | 06205892 | A * | 7/1994 | D06F 43/08 |
| JP | 07178289 | A | 7/1995 | |
| JP | 2004089413 | A | 3/2004 | |
| JP | 2008173330 | A | 7/2008 | |
| JP | 2008183298 | A | 8/2008 | |
| WO | WO 9405846 | A1 | 3/1994 | |
| WO | WO 2007074040 | A1 | 7/2007 | |
| WO | WO 2008138779 | A2 * | 11/2008 | F22B 1/18 |
| WO | WO 2009015919 | A1 * | 2/2009 | D06F 58/22 |
| WO | WO 2009106150 | A1 * | 9/2009 | D06F 58/20 |

* cited by examiner

APPARATUS AND METHOD FOR REFRIGERATION CYCLE CAPACITY ENHANCEMENT

CROSS-REFERENCE TO RELATED APPLICATIONS

The present application is a continuation-in-part of, and claims priority to, the U.S. patent application Ser. No. 12/843,148, filed Jul. 26, 2010 now U.S. Pat. No. 8,353,114, and entitled "Apparatus and Method for Refrigeration Cycle with Auxiliary Heating," the disclosure of which is incorporated herein by reference.

BACKGROUND OF THE INVENTION

The subject matter disclosed herein relates to appliances using a mechanical refrigeration cycle, and more particularly to heat pump dryers and the like.

Clothes dryers have typically used electric resistance heaters or gas burners to warm air to be used for drying clothes. These dryers typically work on an open cycle, wherein the air that has passed through the drum and absorbed moisture from the clothes is exhausted to ambient. More recently, there has been interest in heat pump dryers operating on a closed cycle, wherein the air that has passed through the drum and absorbed moisture from the clothes is dried, re-heated, and re-used.

BRIEF DESCRIPTION OF THE INVENTION

As described herein, the exemplary embodiments of the present invention overcome one or more disadvantages known in the art.

One aspect relates to an apparatus comprising: a mechanical refrigeration cycle arrangement having a working fluid and an evaporator, a condenser of adjustable surface area, a compressor, and an expansion device, cooperatively interconnected and containing the working fluid. The apparatus also includes a drum to receive clothes to be dried, a duct and fan arrangement configured to pass air over the condenser and through the drum, a sensor located to sense at least one parameter, and a controller coupled to the sensor, condenser and/or the compressor. The controller is operative to adjust the condenser to increase surface area during a steady state drying rate period of the cycle, and adjust the condenser to decrease surface area during a start transient period of the cycle, wherein adjusting the condenser to decrease surface area during a start transient period of the cycle accelerates the start transient period of the cycle.

Another aspect relates to an apparatus comprising a condenser, which includes a refrigerant input component, a refrigerant output component, a transient coil area, a supplemental coil area, and one or more flow valves.

Yet another aspect of the present invention relates to a method comprising the steps of: in a heat pump clothes dryer operating on a mechanical refrigeration cycle, using a condenser in the heat pump clothes dryer, wherein the condenser is adjustable with respect to surface area, adjusting the condenser to increase surface area during a steady state drying rate period of the cycle, and adjusting the condenser to decrease surface area during a start transient period of the cycle, wherein adjusting the condenser to decrease surface area during a start transient period of the cycle accelerates the start transient period of the cycle.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 1:
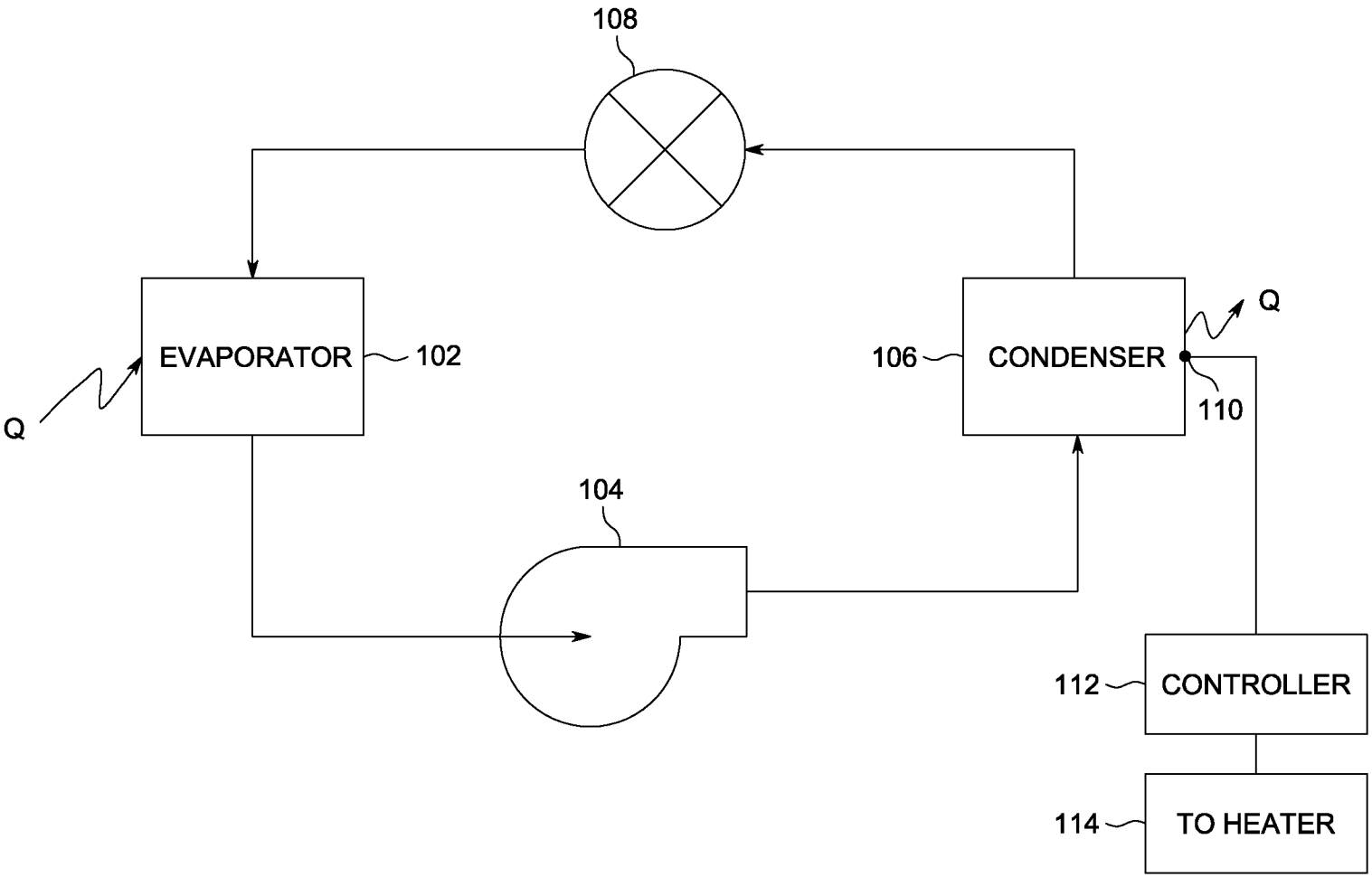
FIG. 1 is a block diagram of an exemplary mechanical refrigeration cycle, in accordance with a non-limiting exemplary embodiment of the invention.

FIG. 1 shows an exemplary embodiment of a mechanical refrigeration cycle, in accordance with an embodiment of the invention. Heat (Q) flows into evaporator 102, causing refrigerant flowing through same to evaporate and become somewhat superheated. The superheated vapor is then compressed in compressor 104, and flows to condenser 106, where heat (Q) flows out. The refrigerant flowing through condenser 106 condenses and becomes somewhat sub-cooled. It then flows through restriction 108 and back to evaporator 102, competing the cycle. In a refrigerator, freezer, or air conditioner, evaporator 102 is located in a region to be cooled, and heat is generally rejected from condenser 106 to ambient. In a heat pump, heat is absorbed from the ambient in evaporator 102 and rejected in condenser 106 to a space to be heated.

In the non-limiting exemplary embodiment of FIG. 1, a temperature or pressure sensor 110 is located in the center of the condenser 106 and is coupled to a controller 112 which, as indicated at 114, in turn controls an auxiliary heater, to be discussed in connection with FIG. 2.

In review, a mechanical refrigeration system includes the compressor 104 and the restriction 108 (either a capillary or a thermostatic expansion valve or some other kind of expansion valve or orifice—a mass flow device just before the evaporator 102 which limits the mass flow and produces the pressures in the low side and high side). The condenser 106 and the evaporator 102 are heat exchange devices and they regulate the pressures. The mass transfer devices 104, 108 regulate the mass flow. The pressure in the middle of the condenser 106 will be slightly less than at the compressor outlet due to flow losses.

Figure 2:
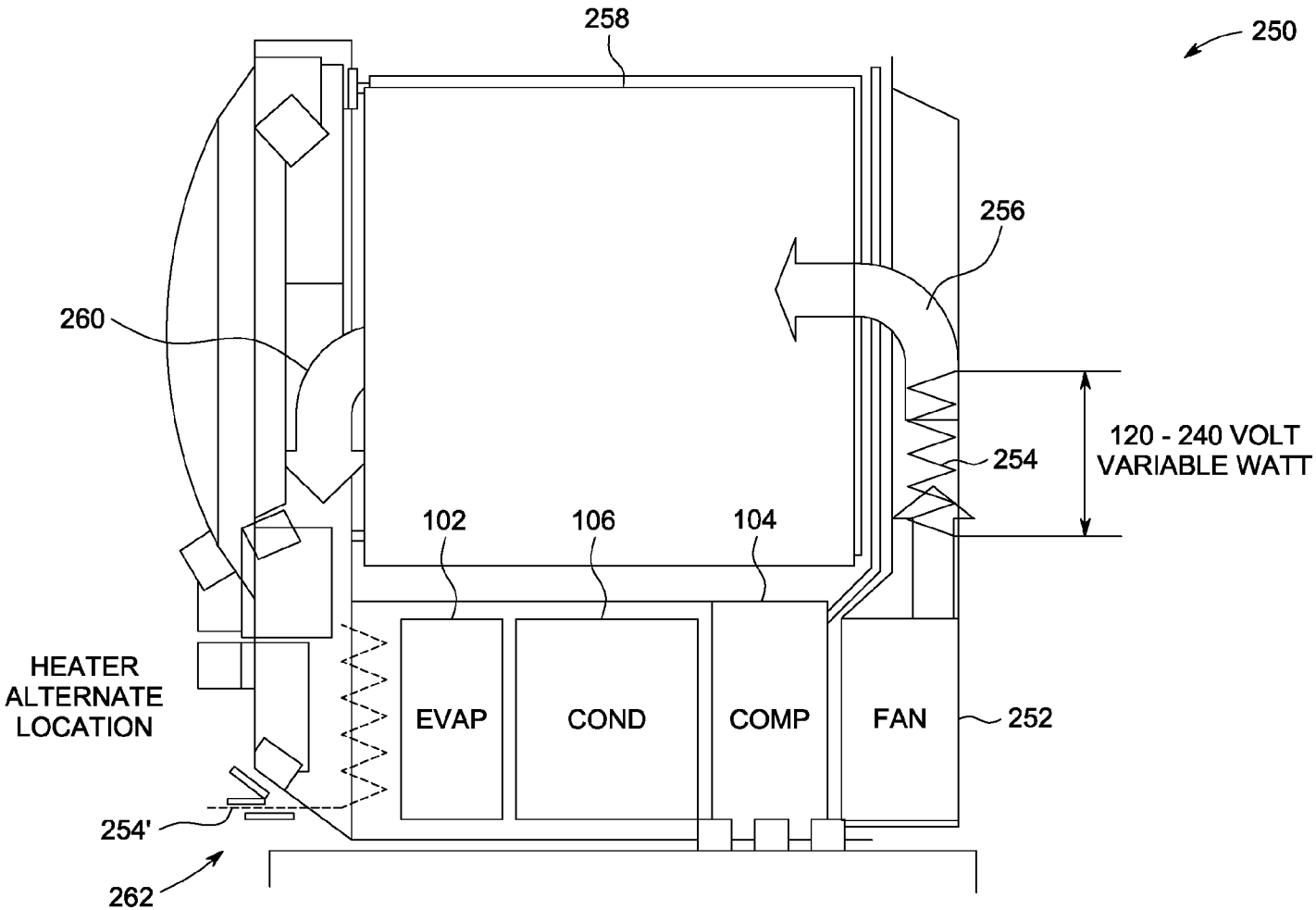
FIG. 2 is a semi-schematic side view of a heat pump dryer, in accordance with a non-limiting exemplary embodiment of the invention.

FIG. 2 shows an exemplary embodiment of a heat pump type clothes dryer 250. The evaporator 102, condenser 106, and compressor 104 are as described above with respect to FIG. 1. The refrigerant lines and the expansion valve 108 are omitted for clarity. Fan 252 circulates air through a supply duct 256 into drum 258 to dry clothes contained therein. The mechanism for rotating the drum 258 can be of a conventional kind and is omitted for clarity. Air passes through the drum 258 into a suitable return plenum 260 and then flows through a return duct 262. Condenser 106 is located in the air path to heat the air so that it can dry the clothes in the drum 258.

One or more embodiments include an auxiliary heater 254 in supply duct 256 and/or an auxiliary heater 254' in return duct 262; in either case, the heater may be controlled by controller 112 as discussed elsewhere herein.

One or more embodiments advantageously improve transient performance during start-up of a clothes dryer, such as dryer 250, which works with a heat pump cycle rather than electric resistance or gas heating. As described with respect to 254, 254', an auxiliary heater is placed in the supply and/or return duct and used to impact various aspects of the startup transient in the heat pump drying cycle.

With continued reference to FIG. 1, again, compressor 104 increases the pressure of the refrigerant which enters the condenser 106 where heat is liberated from the refrigerant into the air being passed over the condenser coils. The fan 252 passes that air through the drum 258 to dry the clothes. The air passes through the drum 258 to the return duct 262 and re-enters or passes through the evaporator 102 where it is cooled and dehumidified (this is a closed cycle wherein the drying air is re-used). In some instances, the heater can be located as at 254, in the supply duct to the drum (after the fan 252 or between the condenser 106 and the fan 252). In other instances, the heater can be located at point 254', in the return duct from the drum 258, just before the evaporator 102.

Thus, one or more embodiments place a resistance heater of various wattage in the supply or return duct of a heat pump dryer to provide an artificial load through the drum 258 to the evaporator 102 by heating the supply and therefore the return air, constituting a sensible load to the evaporator 102 before the condenser 106 is able to provide a sensible load or the clothes load in drum 258 is able to provide a latent psychrometric load. This forces the system to develop higher temperatures and pressures earlier in the run cycle, accelerating the onset of drying performance.

A refrigeration system normally is run in a cycling mode. In the off cycle it is allowed to come to equilibrium with its surroundings. A system placed in an ambient or room type environment will seek room temperature and be at equilibrium with the room. When the system is subsequently restarted, the condenser and evaporator will move in opposite directions from the equilibrium pressure and temperature. Thus, the evaporator will tend towards a lower pressure and/or temperature and the condenser will seek a higher temperature and/or pressure. The normal end cycle straddles the equilibrium pressure and steady state is reached quite quickly.

In one or more embodiments, for system efficiency in a heat pump dryer, operating points that result in both the condenser and evaporator pressures and temperatures being above the equilibrium pressure of the system in the off mode are sought.

Figure 3:
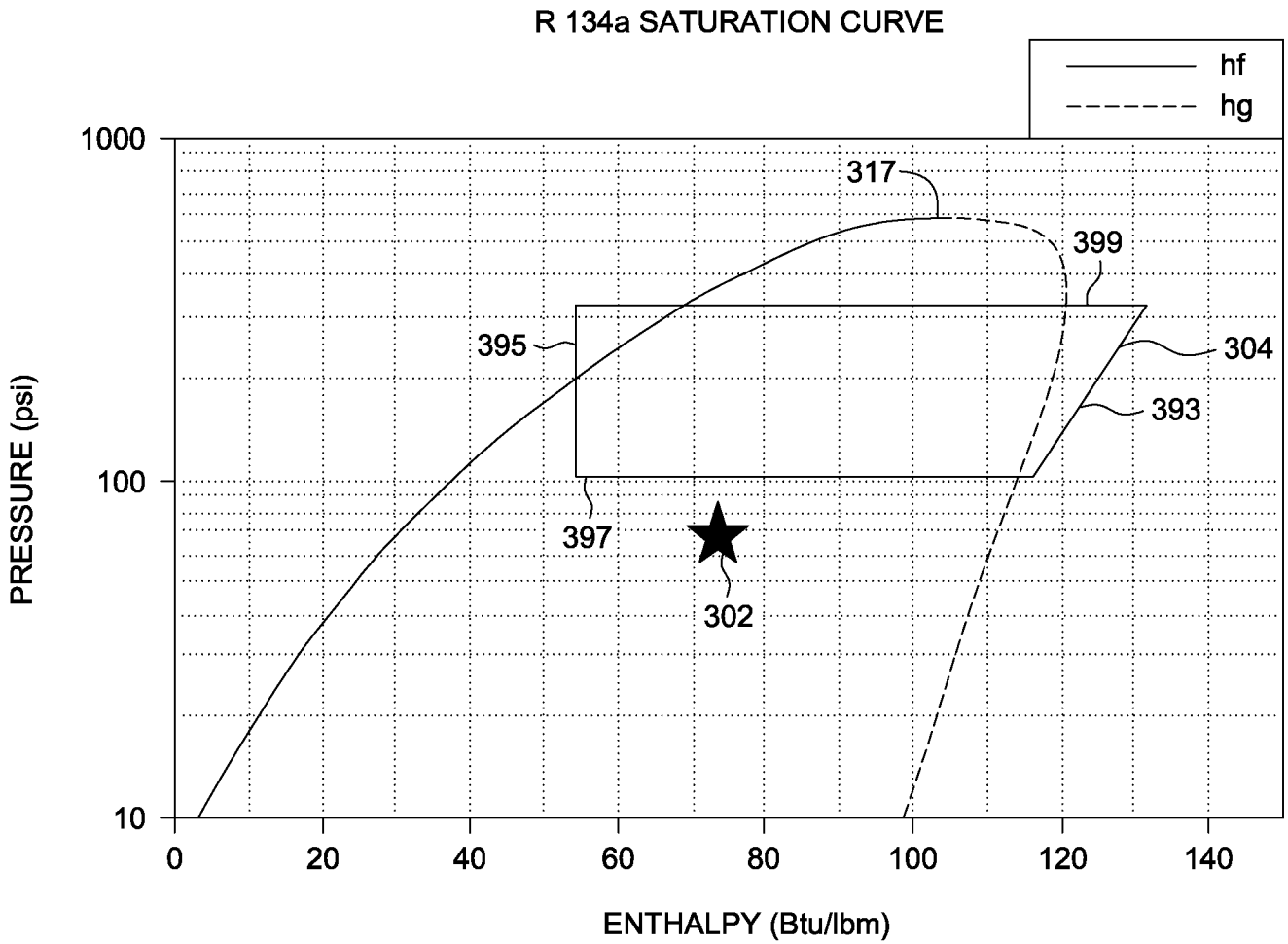
FIGS. 3 and 4 are pressure-enthalpy diagrams illustrating refrigerant cycle elevation, in accordance with a non-limiting exemplary embodiment of the invention.
Figure 4:
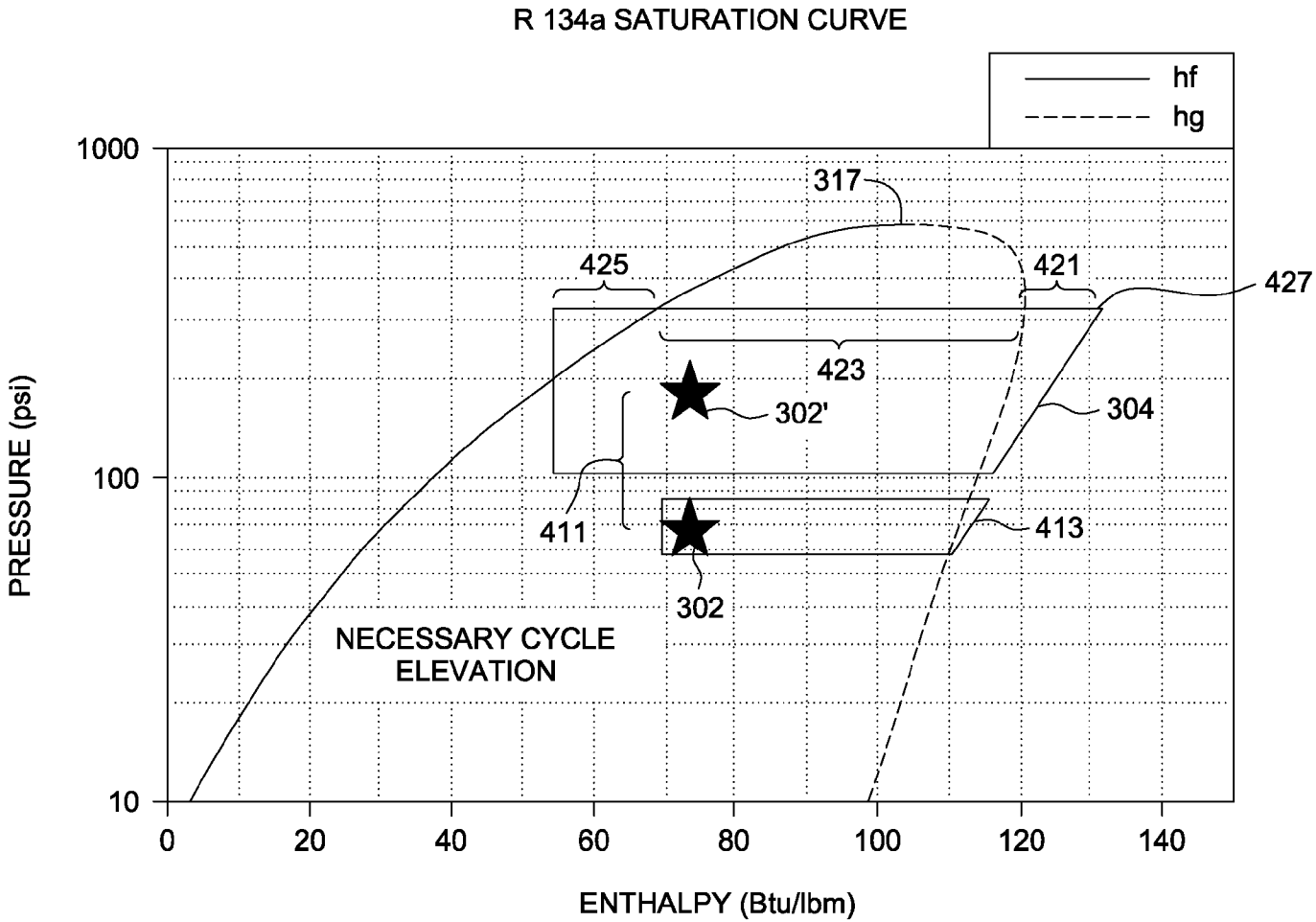

Placing a heater in the supply duct to the drum of a heat pump dryer heats the air up well above ambient temperature as it is presented to the evaporator. If the heater is on at the start of a drying cycle the heat serves to begin the water extraction process in the clothes by evaporation in combination with the airflow by diffusion. The fact that more water vapor is in the air, and the temperature is higher than would otherwise be the case, causes the evaporator to "see" higher temperature than it would otherwise "see." The temperature of the evaporator will elevate to meet the perceived load, taking the pressure with it. Thus the temperature and pressure of the refrigerant are elevated above the ambient the refrigerant would otherwise seek as shown in FIGS. 3 and 4 and described in greater detail below.

With each subsequent recirculation of the air, a higher level is reached until leakage and losses neutralize the elevating effects. Since a suitably sealed and insulated system will not lose the accumulated heat, the cycle pressure elevation can continue until a quite high pressure and temperature are reached. Thus, the refrigeration system moves into a regime where compressor mass flow is quite high and power consumed is quite low.

With the heater on, the system moves to a higher total average pressure and achieves such a state considerably faster than in a conventional system. This is brought about by supplying the evaporator a definite and instantaneous load. This loading causes the heat exchangers (that is, evaporator 102 and condenser 106) to react and supply better properties to accelerate mass flow through the mass flow devices (the compressor 104 and restrictor 108).

Elevation of a refrigerant cycle's pressures within the tolerance limits of the refrigerant boosts compressor capacity at approximately equal power consumption. Thus, in one or more embodiments, the efficiency of refrigeration cycles is improved as pressures are elevated.

Given the teachings herein, the skilled artisan will be able to install, control, and protect a suitable heater with minimal cost, and will also be able to interconnect the heater with the control unit for effective control.

Refer to the P-h (pressure-enthalpy) diagram of FIG. 3. The star 302 represents the equalization condition. In refrigerators and other refrigeration devices such as air conditioners, dehumidifiers, and the like, a cycle is typically started up around the equalization point. When the compressor starts, it transfers mass from the evaporator or low pressure side, to the high pressure side (condenser). The condenser rejects heat and the evaporator absorbs heat, as described above. Generally, the source temperatures for the heat exchangers are found inside the cycle curve 304. The diagram of FIG. 3 illustrates, rather than lowering (the evaporator pressure) and raising (the condenser pressure) pressures from equilibrium, elevating the cycle 304 completely (that is, both low 397 and high 399 pressure sides) above the equalization pressure at star 302. To accomplish this, provide the aforementioned auxiliary heat source to raise the cycle to a different starting state by preloading the evaporator and causing the system to migrate to a higher pressure-temperature cycle.

Refer now to the P-h diagram of FIG. 4. The necessary cycle elevation is given by the bracket 411 between the two stars 302, 302'. Typically, the system will start in a cycle 413 surrounding the equalization point, which is the lower star 302. Because of the auxiliary heater (which in one or more embodiments need provide only a faction of the power actually needed to dry the clothes), the cycle elevates and spreads to the desired upper envelope 304. By way of review, if the auxiliary heater was not applied, operation would be within the lower cycle 413 wherein, shortly after startup, the upper pressure is between 80 and 90 pound per square inch (PSI) and the lower pressure is between 50 and 60 PSI. Note that these values would eventually change to an upper pressure of about 150 PSI and a lower pressure of about 15 PSI when a steady state was reached. Thus, without the extra heater, the steady state cycle obtained would have a high side pressure of about 150 PSI and a low side pressure of about 15 PSI. Upper envelope 304 shows the results obtained when the auxiliary heater is used. Eventually, the auxiliary heater is preferably shut off to prevent the compressor overheating. Thus, for some period of time during the startup transient, apply extra heat with the auxiliary heater, causing the heat pump to operate in a different regime with a higher level of pressure.

For completeness, note that upper envelope 304 represents, at 393, a compression in compressor 104; at high side 399, condensation and sub-cooling in condenser 106; at 395, an isenthalpic expansion through valve 108, and at low side 397, evaporation in evaporator 102. Enter the condenser as a superheated vapor; give up sensible heat in region 421 until saturation is reached, then remain saturated in region 423 as the quality (fraction of the total mass in a vapor-liquid system that is in the vapor phase) decreases until all the refrigerant has condensed; then enters a sub-cooled liquid region 425.

Heretofore, it has been known to place resistance heaters in the supply (but not return) ducts of heat pump dryers simply to supplement the action of the condenser in heating and drying the air. However, one or more embodiments of the invention control the heater to achieve the desired thermodynamic state of the refrigeration cycle and then shut the heater off at the appropriate time (and/or cycle the heater). With reference to FIG. 4, $h_f$ and $h_g$ are, respectively, the saturated enthalpies of the fluid and gas. When operating at full temperature and pressure, the high side 399 (line of constant pressure) is at approximately 300 PSI, which is very close to the top 317 of the vapor dome curve. At such point, effectiveness of the heat exchanger will be lost, so it is not desirable to keep raising the high side pressure.

Furthermore, at these very high pressures, the compressor is working very hard and may be generating so much heat at the power at which it is running that the compressor temperature increases sufficiently that the thermal protection device on the compressor shuts the compressor off. In one or more embodiments, employ a sensor 110, such as a pressure transducer and/or a thermal measurement device (for example, a thermocouple or a thermistor) and monitor the high side temperature and/or the high side pressure. When they reach a certain value which it is not desired to exceed, a controller 112 (for example, an electronic control) turns the heater off.

To re-state, a pressure transducer or a temperature sensor is located in the high side, preferably in the middle of the condenser (but preferably not at the very entrance thereof, where superheated vapor is present, and not at the very outlet thereof, where sub-cooled liquid is present). The center of the condenser is typically operating in two phase flow, and other regions may change more quickly than the center of the condenser (which tends to be quite stable and repeatable). Other high side points can be used if correlations exist or are developed, but the center of the condenser is preferred because of its stability and repeatability (that is, it moves up at the rate the cycle is moving up and not at the rate of other transients associated with the fringes of the heat exchanger). Thus, one or more embodiments involve sensing at least one of a high side temperature and a high side pressure; optionally but preferably in the middle of the condenser.

Comments will now be provided on the exemplary selection of the pressure or temperature at which the auxiliary heater is turned off. There are several factors of interest. First, the compressor pressure can reach almost 360 or 370 PSI, and the compressor will still function, before generating enough heat such that the thermal protection device shuts it off, as described above. This, however, is typically not the limiting condition; rather, the limiting condition is the oil temperature. The compressor lubricating oil begins to break down above about 220 degrees Fahrenheit (F) (temperature of the shell, oil sump, or any intermediate point in the refrigerant circuit). Initially, the oil will generate corrosive chemicals which can potentially harm the mechanism; furthermore, the lubricating properties are lost, which can ultimately cause the compressor to seize up. In one or more embodiments, limit the condenser mid temperature to no more than 190 degrees F., preferably no more than 180 degrees F., and most preferably no more than 170 degrees F. In this manner, when the heater is shut off, the compressor will stabilize at a point below where any of its shell or hardware temperatures approach the oil decomposition temperature. With regard to discharge temperature, note that point 427 will typically be about 210 degrees F. when the high side pressure is at about 320 PSI. The saturation temperature at that pressure (middle of the condenser) will be about 170 degrees F. and therefore control can be based on the mid-condenser temperature. The compressor discharge 427 is typically the hottest point in the thermodynamic cycle. The discharge is a superheated gas. The discharge gas then goes through a convective temperature change (FIG. 4 reference character 421 temperature drop) until the constant "condensing temperature" is reached. This is most accurately measured in the center of the condenser. Oil is heated by contact with the refrigerant and by contact with metal surfaces in the compressor. Generally the metal parts of the inside of the compressor run 20-30 degrees F. above the hottest point measured on the outside. The actual temperature to stay below is, in one or more embodiments, 250 degrees F. Thus, there is about a 10 degree F. margin worst case. In one or more embodiments, when the cycle is run up to this point, the maximum capacity is obtained at minimum energy, without causing any destructive condition in the compressor. Heretofore, compressors have not been operated in this region because compressor companies typically will not warrant their compressors in this region.

As noted, prior techniques using a heater do so to provide auxiliary drying capacity, not for system operating point modification, and do not carry out any sensing to turn the heater off. One or more embodiments provide a sensor 110 and a controller 112 that shut off the heater 254, 254' at a predetermined point, as well as a method including the step of shutting off the heater at a predetermined point.

Any kind of heater can be used. Currently preferred are twisted Nichrome wire (nickel-chromium high-resistance heater wire) ribbon heaters available from industrial catalogs, commonly used in hair dryers and the like.

Figure 5:
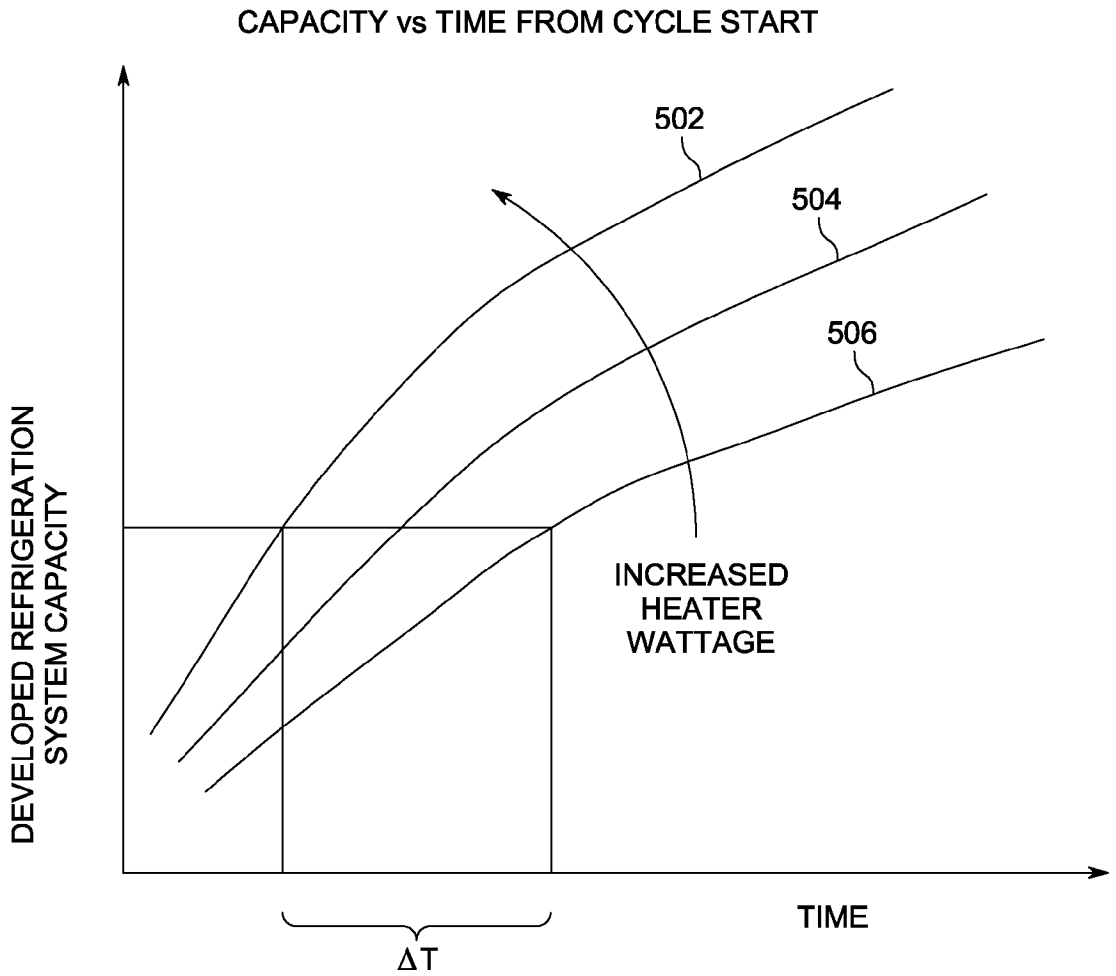
FIG. 5 presents capacity rise curves for a refrigeration system operating at elevated state points, in accordance with a non-limiting exemplary embodiment of the invention.

With the desired ending cycle for a heat pump dryer at a significant elevation above the normal air conditioning state points the transient for cycle elevation is quite long. The application of an external heater 254, 254' accelerates that transient. The observed effect is directly proportional to heater power. That is, the more power input to the auxiliary heater, the faster effective capacity and total system capacity are developed. Refer to FIG. 5, which depicts capacity rise curves of a refrigeration system operating at elevated state points with an auxiliary heater in the air circuit. The rate of capacity rise is proportional to power applied.

The faster onset of effective capacity accelerates the drying process and reduces drying time. With the heater on, the system not only moves to a higher total average pressure (and thus temperature), but also gets there significantly faster.

Thus, in one or more embodiments, application of an independent heat source to a heat pump airside circuit accelerates the progress of a refrigeration system to both effective capacity ranges and final desired state points.

Any one, some, or all of four discrete beneficial effects of the auxiliary heater can be realized in one or more embodiments. These include: (1) total amount of heat transfer attainable; (2) rate at which system can come up to full capacity; (3) cycle elevation to obtain a different state than is normally available; and (4) drying cycle acceleration.

With regard to point (2), capacity, that is, the time it takes to get to any given capacity—it has been found that this is related to the heater and the size of the heater. In FIG. 5, time is on the lower (X) axis and capacity is on the vertical (Y) axis. Recall that with the heater elevating the system operating point, it is possible to operate at 2-3 times the rated value. The rated power of a compressor is determined by running a high back pressure compressor (air conditioning) typically at about 40 degrees F. evaporating temperature and about 131 degrees F. condensing temperature. At this rating point the rated value for an exemplary compressor is about 5000 or 7000 British thermal units per hour (Btu/hr). Elevated pressures in accordance with one or more embodiments will make the compressor able to pump about 12000 or 15000 Btu/hr. This is why it is advantageous to elevate the system operating state points, to get the extra capacity. The power (wattage) of the heater also determines how fast these extra-rated values can be obtained. FIG. 5 shows the start-up curves of developed capacity versus time. With the heater in the system, it is possible to obtain more capacity faster by increasing the heater wattage.

One aspect relates to the final selection of the heater component to be installed in the drier. Thus, one or more embodiments provide a method of sizing a heater for use in a heat pump drier. The capacity ("Y") axis reads "developed refrigeration system capacity" as it does not refer to the extra heating properties of the heater itself, but rather how fast the use of the heater lets the refrigerant system generate heating and dehumidifying capacity. Existing systems dry clothes with the electric heat as opposed to accelerating the refrigerating system coming up to full capacity. The size of the heater that is eventually chosen can help determine how fast the system achieves full capacity—optimization can be carried out between the additional wattage of the heater (and thus its power draw) and the capacity (and power draw) of the refrigeration system. There will be some optimum; if the heater is too large, while the system will rapidly come up to capacity, more total energy will be consumed than at the optimum point, due to the large heater size, whereas if the heater is too small, the system will only slowly come up to capacity, requiring more power in the refrigeration system, and again more energy will be consumed than at the optimum point. This effect can be quantified as follows. The operation of the heater involves adding power consumption for the purpose of accelerating system operation to minimize dry time. It has been determined that, in one or more embodiments, there does not appear to be a point at which the energy saved by shortening the dry time exceeds the energy expended in the longer cycle. Rather, in one or more embodiments, the total power to dry, over a practical range of heater wattages, monotonically increases with heater power rating while the efficiency of the unit monotonically decreases with heater wattage. That is to say that, in one or more embodiments, the unit never experiences a minima where the unit saves more energy by running a heater and shortening time rather than not. Thus, in one or more embodiments, the operation of a heater is a tradeoff based on desired product performance of dry time vs. total energy consumption.

In another aspect, upper line 502 represents a case where compressor power added to heater power is greater than the middle line 504. Lower line 506 could represent a case where compressor power plus heater power is less than middle line 504 but the time required to dry clothes is too long. Center line 504 represents an optimum of shortest time at minimum power. In other words, for curve 504, power is lowest for maximum acceptable time. Lower line 506 may also consume more energy, as described above, because the compressor would not be operating as efficiently.

Figure 6:
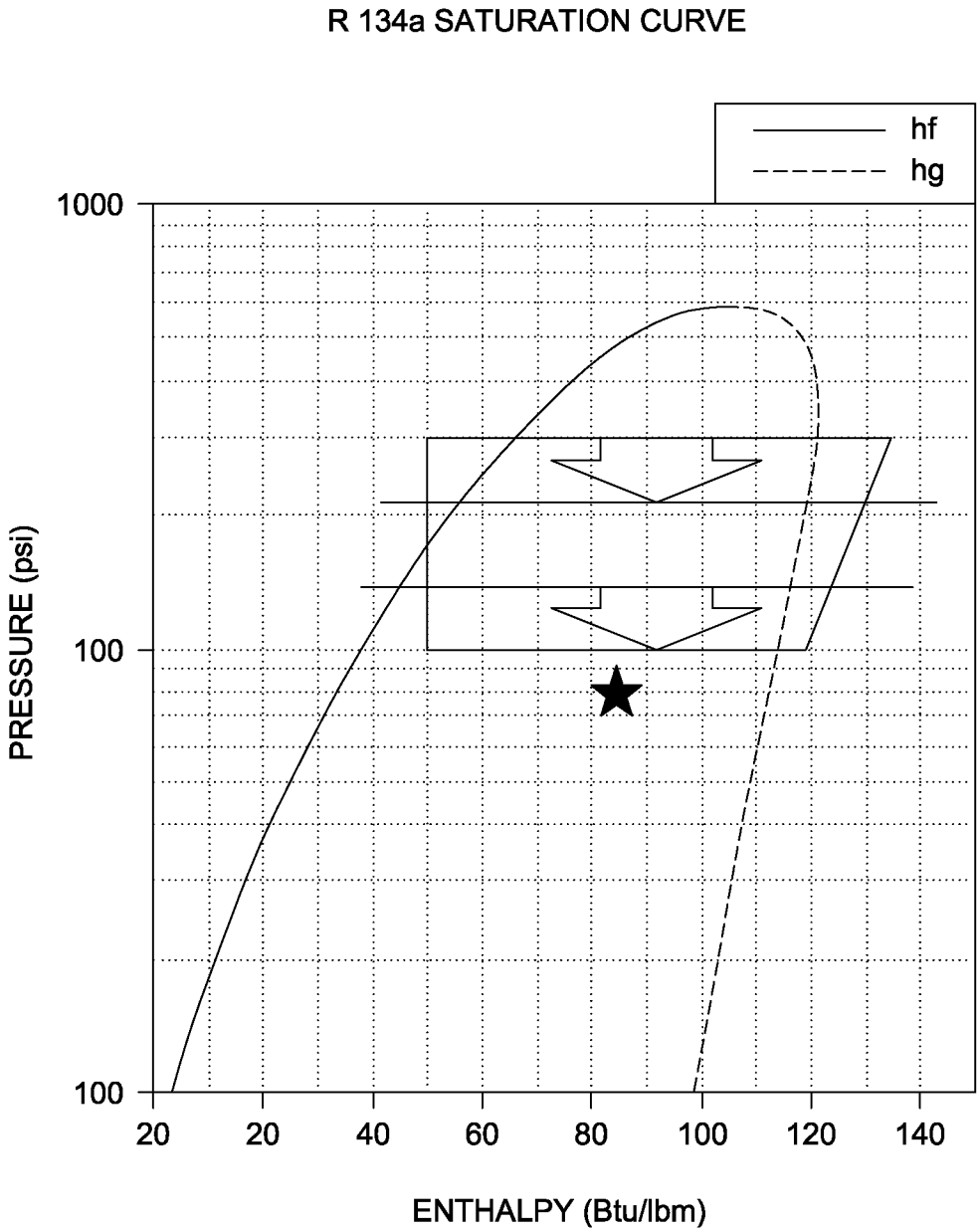
FIG. 6 is a pressure-enthalpy diagram illustrating a basic vapor compression cycle is in thermal and mass flow balance until an external source causes the balance to be upset, in accordance with a non-limiting exemplary embodiment of the invention.

As shown in FIG. 6, a basic vapor compression cycle is in thermal and mass flow balance until an external source causes the balance to be upset.

Figure 7:
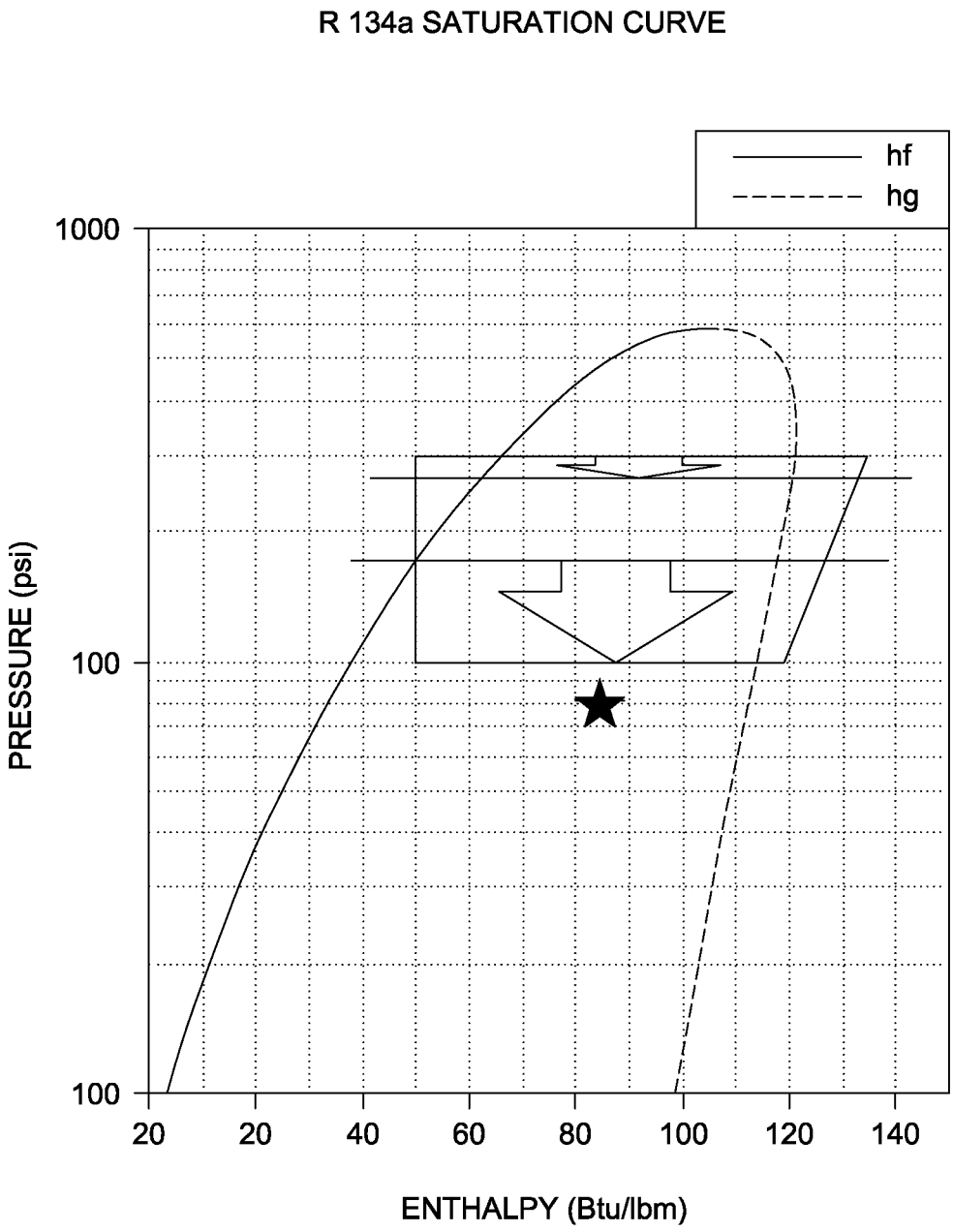
FIG. 7 is a pressure-enthalpy diagram illustrating temperature shift from auxiliary heating causes heat transfer imbalance and mass flow restriction in capillary resulting in capacity increase in evaporator, pressure elevation in condenser and mass flow imbalance, in accordance with a non-limiting exemplary embodiment of the invention.

The temperature shift from auxiliary heating causes heat transfer imbalance and mass flow restriction in the capillary (or other expansion valve) resulting in capacity increase in the evaporator and pressure elevation in the condenser. Mass flow imbalance is also a result, as seen in FIG. 7, which depicts the imbalance created by additional heat input at the evaporator by raised return temperature.

Figure 8:
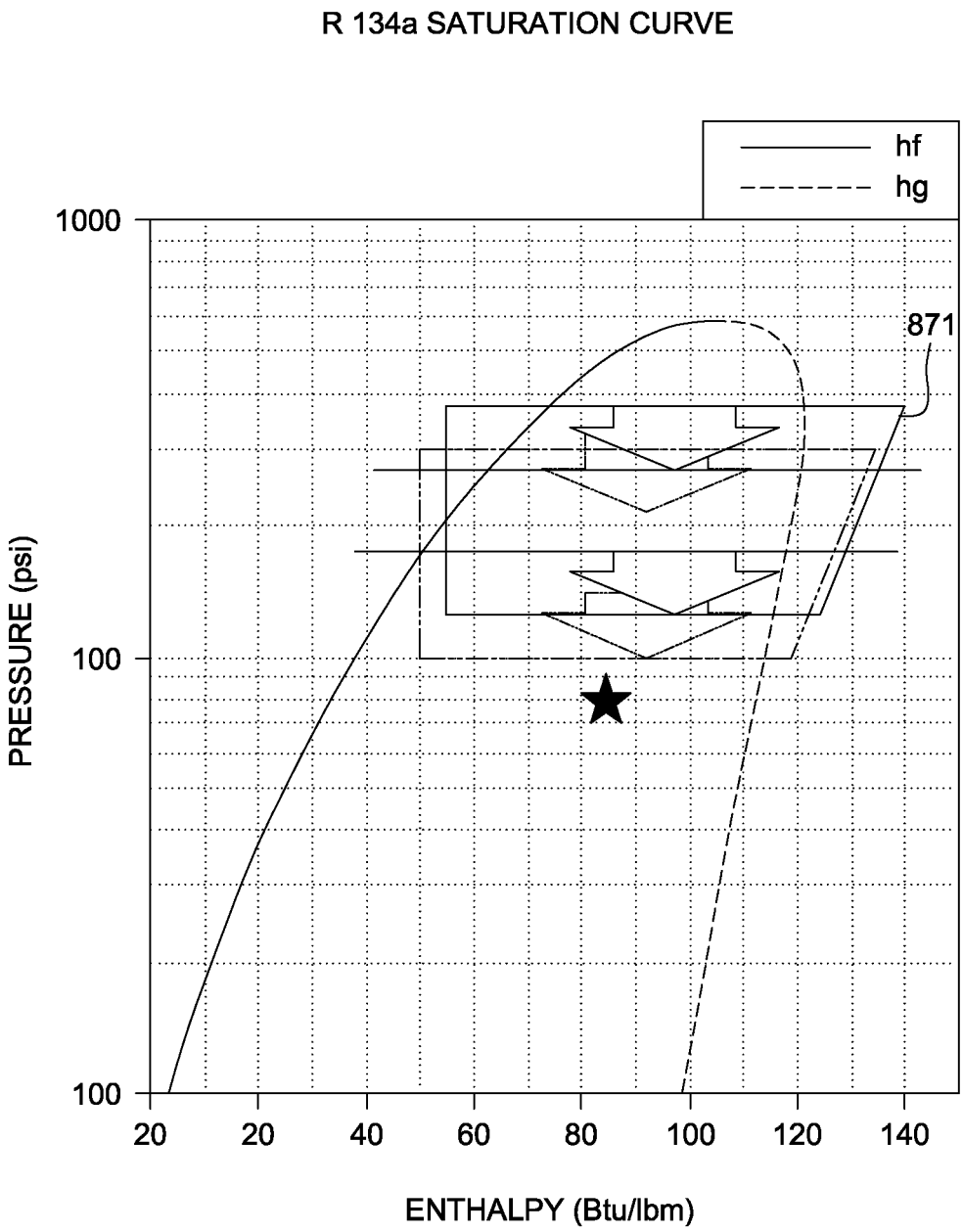
FIG. 8 is a pressure-enthalpy diagram illustrating mass flow through compressor increases due to superheating resulting in further pressure increase in condenser, the dynamic transient is completed when condenser reestablished subcooling and heat flow balance at higher pressures and the net effect is higher average heat transfer during process migration, in accordance with a non-limiting exemplary embodiment of the invention.

Mass flow through the compressor increases due to superheating resulting in further pressure increase in the condenser. The dynamic transient is completed when the condenser reestablishes sub-cooling and heat flow balance at higher pressures. The net effect is higher average heat transfer during process migration. FIG. 8 shows thermal and mass flow equilibrium reestablished at higher state points after the heat input transient.

One or more embodiments thus enable an imbalance in heat exchange by apparently larger capacity that causes more heat transfer to take place at the evaporator. The imbalance causes an apparent rise in condenser capacity in approximately equal proportion as the condensing pressure is forced upward. The combined effect is to accelerate the capacity startup transient inherent in heat pump dryers.

Experimentation has demonstrated the effect of capacity augmentation through earlier onset of humidity reduction and moisture collection in a run cycle.

Referring again to FIGS. 6-8, via the elevated cycle, it is possible to increase the capacity, inasmuch as the temperature shift from auxiliary heating causes heat transfer imbalance and mass flow restriction in the capillary (or other expansion valve) resulting in capacity increase in the evaporator and pressure elevation in the condenser. Mass flow imbalance is also a result. Furthermore, mass flow through the compressor increases due to superheating, resulting in further pressure increase in the condenser. The dynamic transient is completed when the condenser re-establishes sub-cooling and heat flow balance at higher pressures. The net effect is higher average heat transfer during process migration.

Heat is transferred by temperature difference (delta T). The high-side temperature 871 is at the top of the cycle diagram in FIG. 8. When that temperature is elevated, there is a larger delta T between the sink temperature (air to which heat is being rejected) and the actual temperature of the heat exchanger (condenser) itself. The imbalance caused by the auxiliary heater increases delta T and thus heat transfer which creates an apparent increase in capacity above that normally expected at a given condensing pressure or temperature. The effect is analogous to a shaker on a feed bowl; in effect, the heater "shakes" the refrigeration system and makes the heat move more efficiently. Again, it is to be emphasized that this is a thermodynamic effect on the heat pump cycle, not a direct heating effect on the clothes.

One or more embodiments of the invention pulse or cycle a heater in a heat pump clothes dryer to accomplish control of the heat pump's operating point. As noted above, placing a resistance heater of various wattage in the supply and/or return ducts of a heat pump dryer provides an artificial load through the drum to the evaporator by heating the supply and therefore the return air, constituting an incremental sensible load to the evaporator. This forces the system to develop higher temperatures and pressures that can cause the cycle to elevate continuously while running. In some embodiments, this can continue well past the time when desired drying performance is achieved. When the heater is turned off during a run cycle the cycle tends to stabilize without additional pressure and/or temperature rise, or even begin to decay. If the system operating points decay the original growth pattern can be repeated by simply turning the heater back on. Cycling such a heater constitutes a form of control of the capacity of the cycle and therefore the rate of drying.

As noted above, for system efficiency in a heat pump dryer, seek operating points that result in both the condenser and evaporator well above the equilibrium pressure of the system in off mode. In one or more embodiments, this elevation of the refrigeration cycle is driven by an external forcing function (that is, heater 254, 254').

Further, in a normal refrigeration system, the source and sink of the system are normally well established and drive the migration to steady state end points by instantly supplying temperature differences. Such is not the case with a heat pump dryer, which typically behaves more like a refrigerator in startup mode where the system and the source and sink are in equilibrium with each other.

As noted above, with each subsequent recirculation of the air, a higher cycle level is reached until leakage and losses neutralize the elevating effects. Since a properly sealed and insulated system will not lose this accumulated heat, the cycle pressure elevation can continue until quite high pressure and temperature are reached. Thus, the refrigeration system moves into a regime where compressor mass flow is quite high and power consumed is quite low. However, a properly sealed and insulated system will proceed to high enough head pressures to shut off the compressor or lead to other undesirable consequences. In one or more embodiments, before this undesirable state is reached, the heater is turned off, and then the system states begin to decay and or stabilize. In one or more embodiments, control unit 112 controls the heater in a cycling or pulse mode, so that the system capacity can essentially be held constant at whatever state points are desired.

One or more embodiments thus provide capacity and state point control to prevent over-temperature or over-pressure conditions that can be harmful to system components or frustrate consumer satisfaction.

Figure 9:
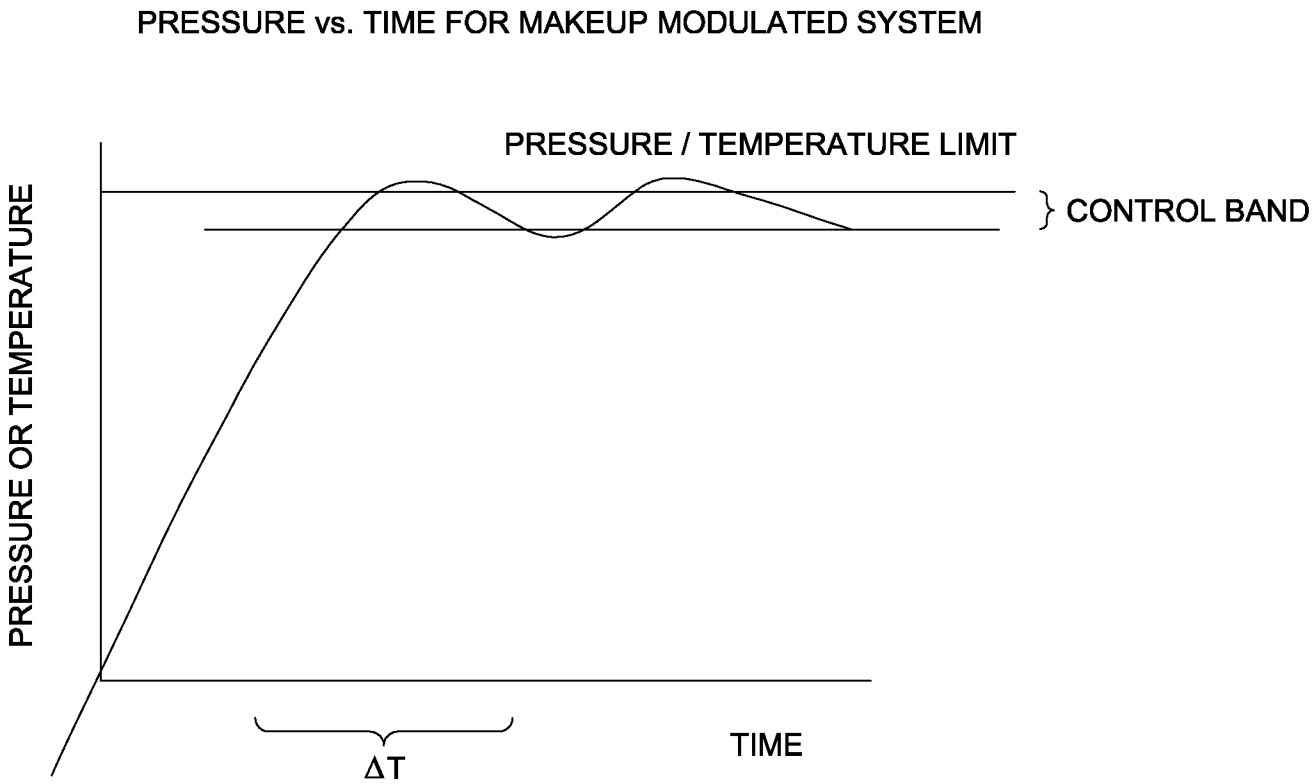
FIG. 9 presents pressure versus time for a cycle wherein an auxiliary heater is pulsed, in accordance with a non-limiting exemplary embodiment of the invention.

With reference now to FIG. 9, it is possible to accelerate the time in which the system comes up to full capacity. Once the system comes up to full capacity, then it is desired to ensure that the compressor is not overstressed. In some embodiments, simply turn off the heater when the temperature and/or pressure limits are reached (for example, above-discussed temperature limits on compressor and its lubricant). In other cases, the heater can be cycled back on and off during the drying cycle. In the example of FIG. 9, the heater is cycled within the control band to keep the system at an elevated state.

Accordingly, some embodiments cycle the heater to keep the temperature elevated to achieve full capacity. By way of review, in one aspect, place a pressure or temperature transducer in the middle of the condenser and keep the heater on until a desired temperature or pressure is achieved. In other cases, carry this procedure out as well, but selectively turn the heater back on again if the temperature or pressure transducer indicates that the temperature or pressure has dropped off.

Determination of a control band is based on the sensitivity of the sensor, converter and activation device and the dynamic behavior of the system. These are design activities separate from the operation of the principle selection of a control point. Typically, in a control, a desired set point or comfort point is determined (for example, 72 degrees F. for an air conditioning application). Various types of controls can be employed: electro-mechanical, electronic, hybrid electro-mechanical, and the like; all can be used to operate near the desired set or comfort point. The selection of dead bands and set points to keep the net average temperature at the desired value are within the capabilities of the skilled artisan, given the teachings herein. For example, an electromechanical control for a room may employ a 7-10 degree F. dead band whereas a 3-4 degree F. dead band might be used with an electronic control. To obtain the desired condenser mid temperature, the skilled artisan, given the teaching herein, can set a suitable control band. A thermistor, mercury contact switch, coiled bimetallic spring, or the like may be used to convert the temperature to a signal usable by a processor. The activation device may be, for example, a TRIAC, a solenoid, or the like, to activate the compressor, heater, and so on. The dynamic behavior of thermal systems may be modeled with a second order differential equation in a known manner, using inertial and damping coefficients. The goal is to cycle the auxiliary heater during operation to protect the compressor oil from overheating.

As described herein, one or more embodiments of the invention include techniques and apparatuses for refrigeration cycle capacity enhancement via use of an auxiliary heater. As such, one or more embodiments of the invention include using an auxiliary heater in a heat pump dryer to pre-load the evaporator and cause the high-side temperature to increase to produce a larger delta T with the ambient, enabling the use of a smaller condenser.

As described herein, a resistance heater of various wattage can be placed in the supply or return ducts of a heat pump dryer (as shown, for example, in FIG. 2) to provide an artificial load through the drum to the evaporator by heating the supply and therefore the return air, constituting a sensible load to the evaporator before the ability to provide a full load by the sensible condenser heating and psychrometric load from the clothes. This forces the system to develop higher temperatures and pressures earlier in the run cycle, accelerating the onset of drying performance.

One or more embodiments of the invention make possible the imbalance in heat exchange by apparently larger capacity that causes more heat exchange to take place at the evaporator. The imbalance causes an apparent rise in condenser capacity in approximately equal proportion as the condensing pressure is forced upward. The combined effect is to accelerate the capacity startup transient inherent in heat pump dryers. By way of example and not limitation, one or more embodiments of the invention can produce approximately a 15-25% reduction in dry time as the start-up transient is reduced. As detailed herein, one or more embodiments of the invention can additionally illustrate the effect of capacity augmentation through earlier onset of humidity reduction and moisture collection in a run cycle.

As further described herein, an auxiliary heater can create an imbalance in heat transfer that takes place at the evaporator. Further, a mass flow restriction in capillary results in capacity increase in the evaporator and pressure elevation in a condenser. An increased pressure in the condenser further increases the mass flow through the compressor, and the combined effect is higher average heat transfer and a reduction in dry time as the start-up transient is reduced.

As noted herein, a basic vapor compression cycle is in thermal and mass flow balance until an external source causes the balance to be upset (see, for example, FIG. 6). Also, a temperature shift from auxiliary heating causes heat transfer imbalance and mass flow restriction in capillary, resulting in capacity increase in the evaporator and pressure elevation in the condenser. Mass flow imbalance is also a result (see, for example, FIG. 7). Mass flow through the compressor increases due to superheating, resulting in further pressure increase in the condenser. The dynamic transient is completed when the condenser reestablishes sub-cooling and heat flow balance at higher pressures. The net effect is a higher average heat transfer during process migration.

Refer again to FIG. 8. Heat is transferred by temperature difference. The high-side temperature 871 is at the top of the cycle diagram in FIG. 8. When that temperature is elevated, there is a larger delta T between the sink temperature (air to which heat is being rejected) and the actual temperature of the heat exchanger itself. The imbalance caused by the auxiliary heater increases delta T, and thus heat transfer, which creates an apparent increase in capacity above that normally expected at a given condensing pressure or temperature. The effect is analogous to a shaker on a feed bowl, making everything move easily. That is, the heater "shakes" the refrigeration system and makes the heat move more efficiently. Again, this is a thermodynamic effect on the heat pump cycle, not a direct heating effect on the clothes.

As described in connection with one or more embodiments of the invention, the apparent capacity shift is fundamentally in temperature but only in the transient period. The duration of the transient can be, for example, about 30 minutes and the overall temperature migration can be about 60 degrees Fahrenheit. That is approximately a 2 degrees/minute average, or about 0.5 degree every 15 seconds. By way merely of example, for initial estimating purposes, assume that the temperature difference was about 0.5 degree F.; as such, the apparent capacity shift calculation can be written as follows:

$$Q_{DOT}=UA\Delta T, \quad \text{(equation 1)}$$

where:

$Q_{DOT}$ is heat transfer rate,

U is the specific heat transfer rate at a given air flow rate,

A is the overall frontal area of the heat exchanger/condenser, and

ΔT is the effective temperature difference between the air and the refrigerant.

Transforming equation 1 into a form to represent a condition before temperature shift and after temperature shift, and setting the heat transfer rates equal results in equations 2 and 3:

$$Q_{DOT\,n}=UA_n\Delta T_n \quad \text{(equation 2)}$$

$$Q_{DOT\,1}=Q_{DOT\,2} \quad \text{(equation 3)}$$

$$UA_1\Delta T_1=UA_2\Delta T_2$$

$$A_1\Delta T_1=A_2\Delta T_2$$

$$A_1/A_2=\Delta T_2/\Delta T_1 \quad \text{(equation 4)}$$

$$A_2=A_1(\Delta T_1/\Delta T_2) \quad \text{(equation 5)}$$

Thus, equation 5 provides the proper expression of the potential frontal area reduction of a heat exchanger resulting from the apparent temperature shift of the system in startup. Accordingly, if a heat exchanger of 0.75 $ft^2$ frontal area were running a 10° F. temperature difference, and the apparent temperature shift were deemed to be 0.5° F., then the area of the coil could be:

$$A_2=A_1(10/10.5)$$

$$A_2=0.95A_1,$$

or a 5% material reduction at first estimate.

Additionally, in one or more embodiments of the invention, the calculation of effective surface area can be used and the area can be scaled accordingly. Such techniques can be used, for example, if frontal area is available to increase effectiveness further and enable slightly higher mass reduction by taking the material in a less effective flow-wise length of coil.

A sizing exercise can account for the shift phenomena during transient operation. Fully half, if not more, of the run time of a dry cycle is during the relatively steady state constant drying rate period. Thus, this apparent shift is not observed and the full designed heat transfer surface area is desired, or else the actual temperature difference will rise causing the system to operate less efficiently.

Figure 10:
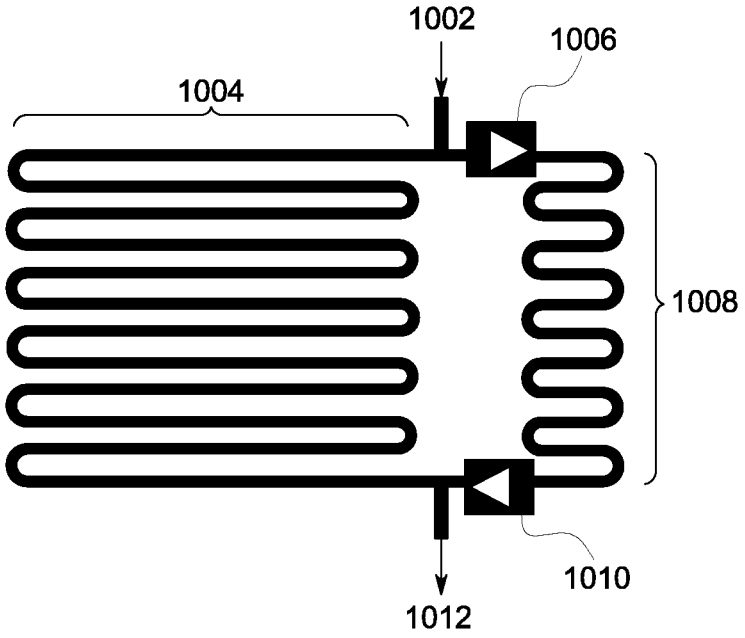
FIG. 10 presents an example adapted heat exchanger, in accordance with a non-limiting exemplary embodiment of the invention.

When this is overcome by making part of the heat exchanger selectively inactive by plumbing modifications and adding flow valves, as shown in FIG. 10, the system can adjust quite readily to the conditions and be more easily optimized for start and run.

As such, FIG. 10 presents an adapted heat exchanger, in accordance with a non-limiting exemplary embodiment of the invention. By way of illustration, FIG. 10 depicts an illustration of coil construction and valving to permit reduced area during startup transient and full sized coil for steady state operation. FIG. 10 includes a refrigerant-in component 1002, a transient coil area 1004, a flow valve 1006, a supplemental coil area 1008, a flow valve 1010 and a refrigerant-out component 1012.

Figure 11:
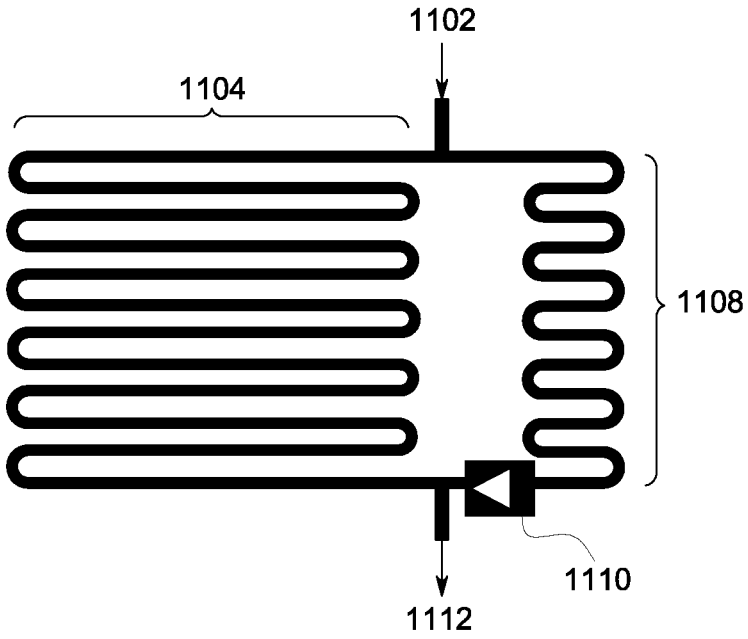
FIG. 11 presents an example adapted heat exchanger, in accordance with a non-limiting exemplary embodiment of the invention.
Figure 12:
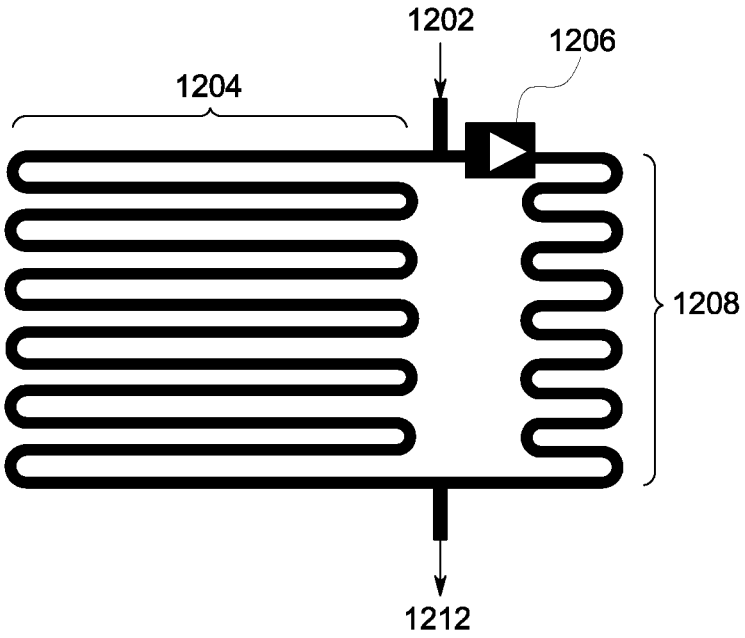
FIG. 12 presents an example adapted heat exchanger, in accordance with a non-limiting exemplary embodiment of the invention.
Figure 13:
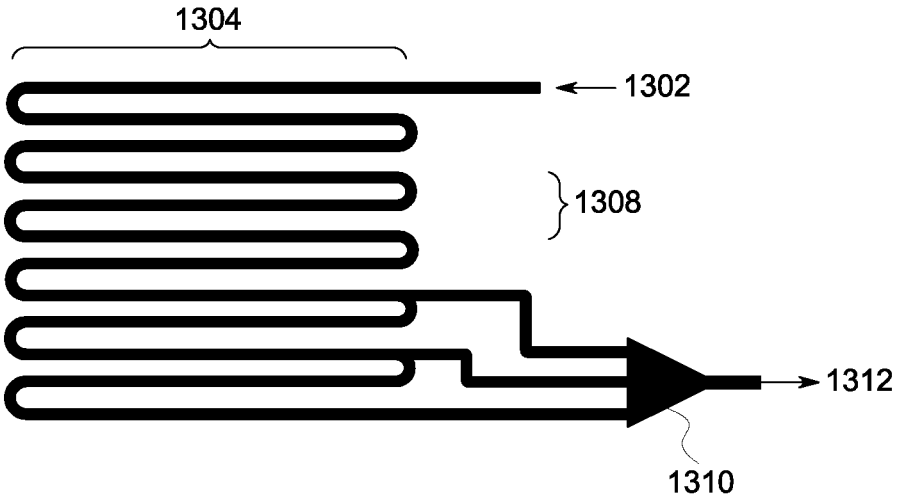
FIG. 13 presents an example adapted heat exchanger, in accordance with a non-limiting exemplary embodiment of the invention.

In one or more embodiments of the invention, the configuration of the heat exchanger can be changed via different valve arrangements, such as depicted in FIG. 11, FIG. 12 and FIG. 13, for instance. By way of example, a single upstream or downstream valve can perform the isolation function; a two-way valve can be used to make various combinations possible; also, a three-way valve can be used to create three zones in the condenser thus allowing further subdivision of the condenser.

FIG. 11 presents an example adapted heat exchanger, in accordance with a non-limiting exemplary embodiment of the invention. By way of illustration, FIG. 11 depicts a refrigerant-in component 1102, a transient coil area 1104, a supplemental coil area 1108 used during steady state operation, an exit flow valve 1110 and a refrigerant-out component 1112.

FIG. 12 presents an example adapted heat exchanger, in accordance with a non-limiting exemplary embodiment of the invention. By way of illustration, FIG. 12 depicts a refrigerant-in component 1202, a transient coil area 1204, an entry flow valve 1206, a supplemental coil area 1208 used during steady state operation, and a refrigerant-out component 1212.

FIG. 13 presents an example adapted heat exchanger, in accordance with a non-limiting exemplary embodiment of the invention. By way of illustration, FIG. 13 depicts a refrigerant-in component 1302, a transient coil area 1304, two supplemental coil areas 1308 used during start transient operation, an exit flow selector valve 1310 and a refrigerant-out component 1312.

One advantage that may be realized in the practice of some embodiments of the described systems and techniques is reducing the drying time of a heat pump clothes dryer using an auxiliary heater. Another advantage that may be realized in the practice of some embodiments of the described systems and techniques is enabling use of a smaller condenser.

Figure 14:
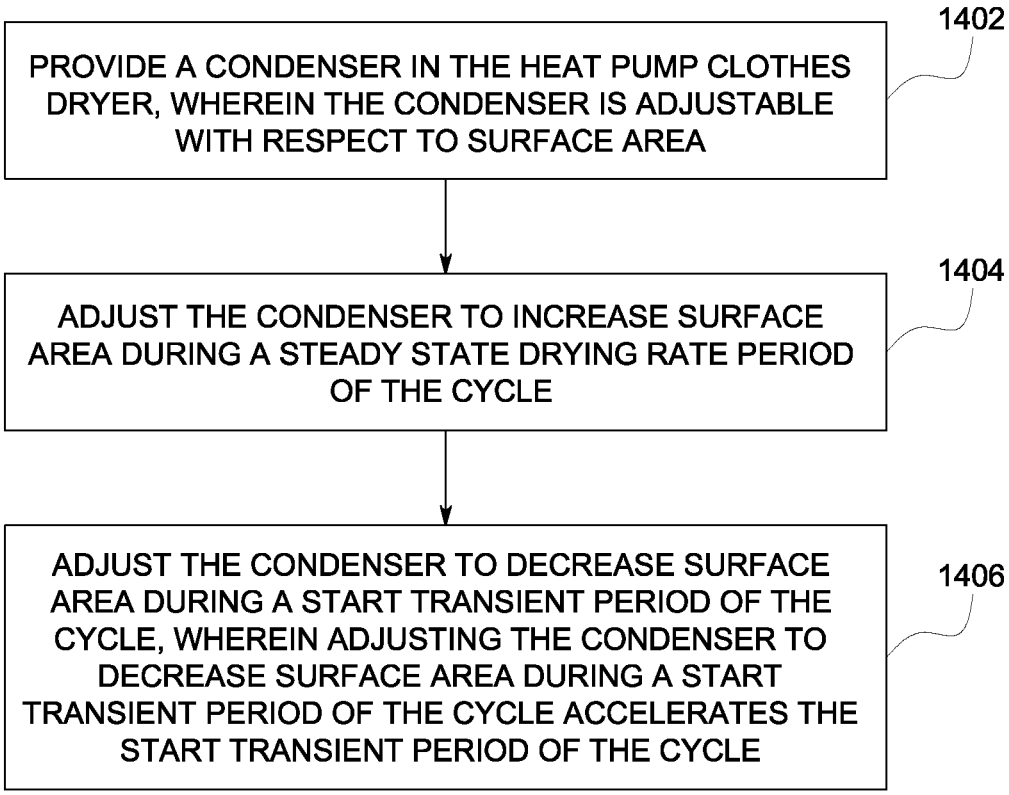
FIG. 14 is a flow chart of a method, in accordance with a non-limiting exemplary embodiment of the invention.

Reference should now be had to the flow chart of FIG. 14. FIG. 14 is a flow chart of a method, in accordance with a non-limiting exemplary embodiment of the invention. Step 1402 includes using a condenser in the heat pump clothes dryer, wherein the condenser is adjustable with respect to surface area.

Step 1404 includes adjusting the condenser to increase surface area during a steady state drying rate period of the cycle. Adjusting the condenser to increase surface area during a steady state drying rate period of the cycle can include using one or more flow valves in the condenser to selectively activate a portion of coil area in the condenser.

Step 1406 includes adjusting the condenser to decrease surface area during a start transient period of the cycle, wherein adjusting the condenser to decrease surface area during a start transient period of the cycle accelerates the start transient period of the cycle. Adjusting the condenser to decrease surface area during a start transient period of the cycle can include using one or more flow valves in the condenser to selectively inactivate a portion of coil area in the condenser. Also, in one or more embodiments of the invention, adjusting the condenser to decrease surface area during a start transient period of the cycle includes correlating adjusting the condenser to decrease surface area with an increasing temperature shift during the transient period of the cycle.

Further, given the discussion thus far, it will be appreciated that, in general terms, an exemplary apparatus, according to another aspect of the invention, includes a mechanical refrigeration cycle arrangement in turn having a working fluid and an evaporator 102, condenser (of adjustable surface area) 106, compressor 104, and an expansion device 108, cooperatively interconnected and containing the working fluid. The apparatus also includes a drum 258 to receive clothes to be dried, a duct and fan arrangement (for example, 252, 256, 260, 262) configured to pass air over the condenser 106 and through the drum 258, and a sensor (for example, 110) located to sense at least one parameter. The at least one parameter includes temperature of the working fluid, pressure of the working fluid, and power consumption of the compressor. Also included is a controller 112 coupled to the sensor, condenser and the compressor. The controller is preferably operative to carry out or otherwise facilitate any one, some, or all of the method steps described. For example, the controller is operative to adjust the condenser to increase surface area during a steady state drying rate period of the cycle, and adjust the condenser to decrease surface area during a start transient period of the cycle, wherein adjusting the condenser to decrease surface area during a start transient period of the cycle accelerates the start transient period of the cycle.

One or more embodiments of the invention can also include an apparatus that comprises a condenser, which includes a refrigerant input component, a refrigerant output component, a transient coil area, a supplemental coil area, and one or more flow valves. As detailed herein, the apparatus can be implemented in a heat pump clothes dryer operating on a mechanical refrigeration cycle. The condenser can enable refrigerant to move through only the transient coil area during a start transient period of the cycle (for example, via maintaining the flow valves in a closed position to selectively inactivate the supplemental coil area). Also, the condenser can enable refrigerant to move through the transient coil area and the supplemental coil area during a steady state drying rate period of the cycle (for example, via maintaining the flow valves in an open position to selectively activate the supplemental coil area).

Figure 15:
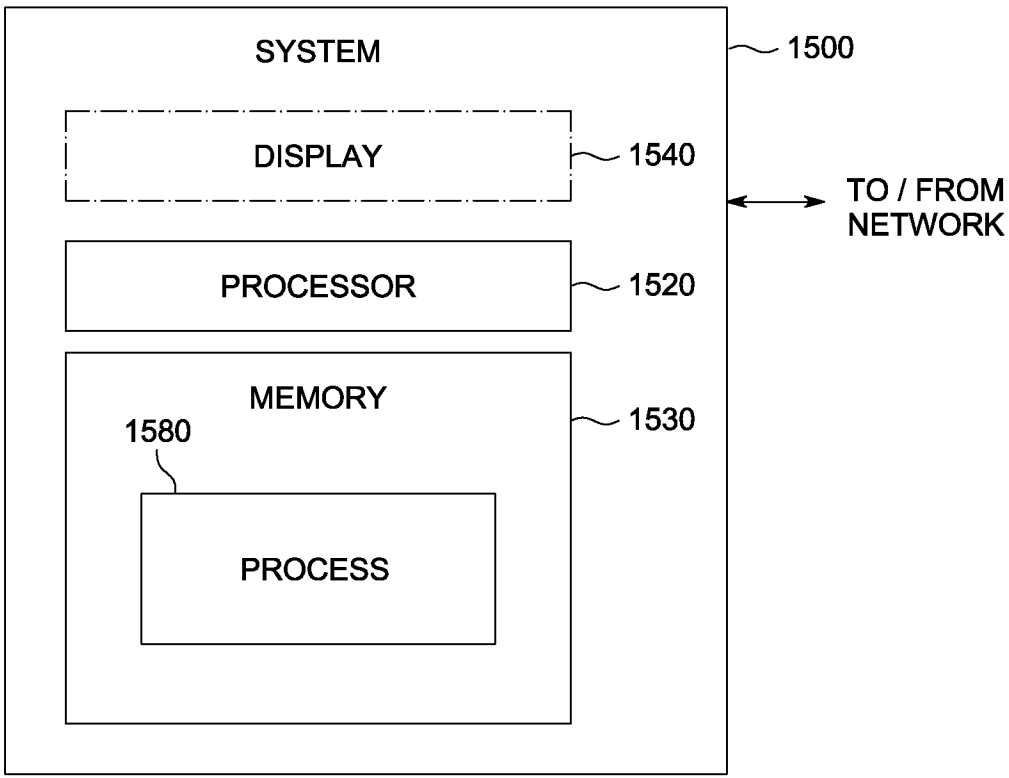
FIG. 15 is a block diagram of an exemplary computer system useful in connection with one or more embodiments of the invention.

Aspects of the invention (for example, controller 112 or a workstation or other computer system to carry out design methodologies) can employ hardware and/or hardware and software aspects. Software includes but is not limited to firmware, resident software, microcode, etc. FIG. 15 is a block diagram of a system 1500 that can implement part or all of one or more aspects or processes of the invention. As shown in FIG. 15, memory 1530 configures the processor 1520 to implement one or more aspects of the methods, steps, and functions disclosed herein (collectively, shown as process 1580 in FIG. 15). Different method steps could theoretically be performed by different processors. The memory 1530 could be distributed or local and the processor 1520 could be distributed or singular. The memory 1530 could be implemented as an electrical, magnetic or optical memory, or any combination of these or other types of storage devices. It should be noted that if distributed processors are employed (for example, in a design process), each distributed processor that makes up processor 1520 generally contains its own addressable memory space. It should also be noted that some or all of computer system 1500 can be incorporated into an application-specific or general-use integrated circuit. For example, one or more method steps (for example, involving controller 112) could be implemented in hardware in an application-specific integrated circuit (ASIC) rather than using firmware. Display 1540 is representative of a variety of possible input/output devices. Examples of suitable controllers have been set forth above. Additionally, examples of controllers for heater control above can also be used for cycle completion. An example can include a micro with read-only memory (ROM) storage of constants and formulae which perform the necessary calculations and comparisons to make the appropriate decisions regarding cycle termination.

As is known in the art, part or all of one or more aspects of the methods and apparatus discussed herein may be distributed as an article of manufacture that itself comprises a tangible computer readable recordable storage medium having computer readable code means embodied thereon. The computer readable program code means is operable, in conjunction with a processor or other computer system, to carry out all or some of the steps to perform the methods or create the apparatuses discussed herein. A computer-usable medium may, in general, be a recordable medium (for example, floppy disks, hard drives, compact disks, EEPROMs, or memory cards) or may be a transmission medium (for example, a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer to read instructions and data, such as magnetic variations on a magnetic medium or height variations on the surface of a compact disk. The medium can be distributed on multiple physical devices (or over multiple networks). As used herein, a tangible computer-readable recordable storage medium is intended to encompass a recordable medium, examples of which are set forth above, but is not intended to encompass a transmission medium or disembodied signal.

The computer system can contain a memory that will configure associated processors to implement the methods, steps, and functions disclosed herein. The memories could be distributed or local and the processors could be distributed or singular. The memories could be implemented as an electrical, magnetic or optical memory, or any combination of these or other types of storage devices. Moreover, the term "memory" should be construed broadly enough to encompass any information able to be read from or written to an address in the addressable space accessed by an associated processor. With this definition, information on a network is still within a memory because the associated processor can retrieve the information from the network.

Thus, elements of one or more embodiments of the invention, such as, for example, the controller 112, can make use of computer technology with appropriate instructions to implement method steps described herein.

Accordingly, it will be appreciated that one or more embodiments of the present invention can include a computer program comprising computer program code means adapted to perform one or all of the steps of any methods or claims set forth herein when such program is run on a computer, and that such program may be embodied on a computer readable medium. Further, one or more embodiments of the present invention can include a computer comprising code adapted to cause the computer to carry out one or more steps of methods or claims set forth herein, together with one or more apparatus elements or features as depicted and described herein.

It will be understood that processors or computers employed in some aspects may or may not include a display, keyboard, or other input/output components. In some cases, an interface with sensor 110 is provided.

It should also be noted that the exemplary temperature and pressure values herein have been developed for Refrigerant R-134a; however, the invention is not limited to use with any particular refrigerant. For example, in some instances Refrigerant R-410A could be used. The skilled artisan will be able to determine optimal values of various parameters for other refrigerants, given the teachings herein.

Thus, while there have shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus comprising:

a mechanical refrigeration cycle arrangement in turn comprising:

a working fluid; and an evaporator, a condenser of adjustable surface area, a compressor, and an expansion device, cooperatively interconnected and containing said working fluid;

a drum to receive clothes to be dried;

a duct and fan arrangement configured to pass air over said condenser and through said drum;

a sensor located to sense at least one parameter; and a controller coupled to said sensor, said condenser and said compressor, said controller being operative to:

adjust the condenser to increase surface area during a steady state drying rate period of the cycle; and adjust the condenser to decrease surface area during a start transient period of the cycle, wherein adjusting the condenser to decrease surface area during a start transient period of the cycle accelerates the start transient period of the cycle.

2. The apparatus of claim 1, further comprising an auxiliary heater.

3. The apparatus of claim 2, wherein the auxiliary heater is located in a supply duct of the apparatus.

4. The apparatus of claim 2, wherein the auxiliary heater is located in a return duct of the apparatus.

5. The apparatus of claim 2, wherein the auxiliary heater comprises a variable watt heater.

6. The apparatus of claim 2, wherein the auxiliary heater provides an artificial load to the evaporator to accelerate system capacity development of the apparatus.

7. The apparatus of claim 1, wherein the condenser includes one or more flow valves.

8. The apparatus of claim 7, wherein in adjusting the condenser to increase surface area during a steady state drying rate period of the cycle, the controller is further operative to use the one or more flow valves in the condenser to selectively activate a portion of coil area in the condenser.

9. The apparatus of claim 7, wherein in adjusting the condenser to decrease surface area during a start transient period of the cycle, the controller is further operative to use the one or more flow valves in the condenser to selectively inactivate a portion of coil area in the condenser.

10. The apparatus of claim 1, wherein in adjusting the condenser to decrease surface area during a start transient period of the cycle, the controller is further operative to correlate adjusting the condenser to decrease surface area with an increasing temperature shift during the transient period of the cycle.

11. An apparatus implemented in a heat pump clothes dryer operating on a mechanical refrigeration cycle, the apparatus comprising:

a condenser of adjustable surface area comprising:

a refrigerant input component;

a refrigerant output component;

a transient coil area;

a supplemental coil area; and one or more flow valves;

a sensor located to sense at least one parameter; and a controller coupled to the sensor and the condenser, the controller being operative to: adjust the condenser to increase surface area during a steady state drying rate period of the cycle; and adjust the condenser to decrease surface area during a start transient period of the cycle.

12. The apparatus of claim 11, wherein the condenser enables refrigerant to move through only the transient coil area during the start transient period of the cycle.

13. The apparatus of claim 12, wherein enabling refrigerant to move through only the transient coil area during the start transient period of the cycle comprises maintaining the one or more flow valves in a closed position to selectively inactivate the supplemental coil area.

14. The apparatus of claim 11, wherein the condenser enables refrigerant to move through the transient coil area and the supplemental coil area during the steady state drying rate period of the cycle.

15. The apparatus of claim 14, wherein enabling refrigerant to move through the transient coil area and the supplemental coil area during the steady state drying rate period of the cycle comprises maintaining the one or more flow valves in an open position to selectively activate the supplemental coil area.

16. A method, in a heat pump clothes dryer operating on a mechanical refrigeration cycle, comprising the steps of:

using a condenser in the heat pump clothes dryer, wherein the condenser is adjustable with respect to surface area;

adjusting the condenser to increase surface area during a steady state drying rate period of the cycle; and adjusting the condenser to decrease surface area during a start transient period of the cycle, wherein adjusting the condenser to decrease surface area during a start transient period of the cycle accelerates the start transient period of the cycle.

17. The method of claim 16, wherein adjusting the condenser to increase surface area during a steady state drying rate period of the cycle comprises using one or more flow valves in the condenser to selectively activate a portion of coil area in the condenser.

18. The method of claim 16, wherein adjusting the condenser to decrease surface area during a start transient period of the cycle comprises using one or more flow valves in the condenser to selectively inactivate a portion of coil area in the condenser.

19. The method of claim 16, wherein adjusting the condenser to decrease surface area during a start transient period of the cycle comprises correlating adjusting the condenser to decrease surface area with an increasing temperature shift during the transient period of the cycle.

* * * * *